US009027571B2

(12) United States Patent
Baker et al.

(10) Patent No.: US 9,027,571 B2
(45) **Date of Patent: *May 12, 2015**

(54) TOOL FOR SEPARATING A HAIR BUNDLE

(71) Applicant: The Procter & Gamble Company, Cincinnati, OH (US)

(72) Inventors: Paul Edmund Baker, Silchester (GB); Gwenalle Deloux, London (GB); Natasha Jane Evans, Andover (GB); Neil Anthony Litten, Sonning (GB); John Edward Sheppard, Woking (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,759

(22) Filed: Nov. 22, 2013

(65) Prior Publication Data

US 2014/0076352 A1 Mar. 20, 2014

Related U.S. Application Data

(63) Continuation of application No. 12/047,712, filed on Mar. 13, 2008, now Pat. No. 8,616,222.

(60) Provisional application No. 60/906,641, filed on Mar. 13, 2007.

(30) Foreign Application Priority Data

Oct. 9, 2007 (EP) ..... 07118115
Mar. 10, 2008 (EP) ..... 08152514

(51) Int. Cl.
*A45D 19/18* (2006.01)
*A45D 7/02* (2006.01)
(Continued)

(52) U.S. Cl.
CPC ..... *A45D 19/0008* (2013.01); *A45D 44/005* (2013.01); *B65D 2203/00* (2013.01);
(Continued)

(58) Field of Classification Search
CPC ... A45D 19/00; A45D 19/0008; A45D 19/02; A45D 19/18; A45D 2019/0066; A45D 2019/0083; A45D 2019/0091; A45D 44/005; A45D 2200/25; B65D 33/1616; B65D 33/1625; B65D 2203/00; B42F 1/06; A46B 2200/1046
USPC ..... 132/202, 200, 270, 203, 207, 208, 210, 132/221, 236, 273, 212, 222, 223, 241, 243, 132/108, 278, 240, 279, 280, 284, 275; 206/581, 823; 24/30.5 S, 30.5 R, 545, 24/563, 570; 242/615.4; 33/512, 562, 563, 33/565, 566; D28/10, 11, 32, 33, 39, 41; 401/9, 10, 196, 183, 207
See application file for complete search history.

(56) References Cited

U.S. PATENT DOCUMENTS 712,657 A * 11/1902 Davis ..... 132/106
887,885 A * 5/1908 Whitney ..... 132/280
(Continued)

FOREIGN PATENT DOCUMENTS

DE 662702 C1 7/1938
DE 197639177 U1 4/1977
(Continued)

*Primary Examiner* — Vanitha Elgart
(74) *Attorney, Agent, or Firm* — James T. Fondriest

(57) ABSTRACT

The present invention relates to a tool (1) for separating a hair bundle (11) comprising a number of hair strands appropriate for receiving a hair treatment composition (15) for creating a hair bundle effect. The hair bundle (11) is received into a through hole (10) via a slit (50). The dimensions of the through hole (10) dictate the appropriate size of a hair bundle (11). In one aspect of the present invention, the tool (1) is substantially flat in order to prevent spillages of hair treatment composition (15) onto the scalp. A gripping layer (70) may extend upon at least a portion of the tool (1) for aiding the grip of the tool (1) to the hair bundle (11).

6 Claims, 16 Drawing Sheets

(51) Int. Cl.

| | |
|---|---|
| ***A01G 13/04*** | (2006.01) |
| ***B25H 3/04*** | (2006.01) |
| ***B65D 33/16*** | (2006.01) |
| ***A41F 1/00*** | (2006.01) |
| ***A41F 1/08*** | (2006.01) |
| ***A41F 1/04*** | (2006.01) |
| ***A44B 11/25*** | (2006.01) |
| ***A44B 17/00*** | (2006.01) |
| ***B42F 1/00*** | (2006.01) |
| ***B42F 1/02*** | (2006.01) |
| ***A45D 19/00*** | (2006.01) |
| ***A45D 44/00*** | (2006.01) |
| ***A45D 19/02*** | (2006.01) |
| *B42F 1/08* | (2006.01) |
| *A44B 1/04* | (2006.01) |

(52) U.S. Cl.

CPC ..... *A45D2019/0091* (2013.01); *A45D 19/00* (2013.01); *A45D 19/02* (2013.01); *A45D 2200/25* (2013.01); *A46B 2200/1046* (2013.01)

(56) References Cited

U.S. PATENT DOCUMENTS

| | | | | | |
|---|---|---|---|---|---|
| 1,447,997 | A | * | 3/1923 | Popin | 132/243 |
| 1,818,714 | A | * | 8/1931 | Johnson | 132/243 |
| 2,272,409 | A | * | 2/1942 | Johnson | 132/281 |
| 2,310,295 | A | | 2/1943 | Keele | |
| 2,397,908 | A | * | 4/1946 | Altman | 132/207 |
| 2,776,667 | A | | 1/1957 | Fitzgerald | |
| 3,030,968 | A | | 2/1960 | Oberstar | |
| 2,962,031 | A | | 11/1960 | Bumgarner | |
| 2,981,990 | A | * | 5/1961 | Balderree, Jr. | 24/30.5 R |
| 3,270,874 | A | * | 9/1966 | Hilton | 206/343 |
| 3,662,767 | A | | 5/1972 | Murtha | |
| 3,702,508 | A | | 11/1972 | Netter | |
| 3,822,441 | A | * | 7/1974 | Paxton | 24/30.5 S |
| 3,921,647 | A | | 11/1975 | Fisher | |
| 4,020,854 | A | | 5/1977 | Caruso | |
| 4,026,413 | A | * | 5/1977 | Britt et al. | 206/343 |
| 4,108,184 | A | | 8/1978 | Morganroth | |
| 4,361,935 | A | * | 12/1982 | Paxton | 24/30.5 R |
| 4,398,549 | A | | 8/1983 | Thomas | |
| 4,503,870 | A | | 3/1985 | Peterson | |
| 4,509,231 | A | * | 4/1985 | Paxton | 24/30.5 R |
| 4,760,624 | A | * | 8/1988 | Fish | 24/30.5 S |
| 4,796,812 | A | | 1/1989 | Grollier | |
| 4,934,387 | A | * | 6/1990 | Megna | 132/201 |
| 4,942,893 | A | | 7/1990 | Trottier | |
| 5,042,514 | A | | 8/1991 | Bastien | |
| 5,060,679 | A | | 10/1991 | Christopher et al. | |
| 5,138,748 | A | * | 8/1992 | Welles | 24/30.5 S |
| 5,279,313 | A | | 1/1994 | Clausen | |
| 5,535,764 | A | | 7/1996 | Abramson | |
| 5,554,197 | A | | 9/1996 | Assini | |
| 5,771,906 | A | | 6/1998 | De Benedictis | |
| 5,810,023 | A | * | 9/1998 | Jones et al. | 132/207 |
| 5,819,761 | A | * | 10/1998 | Sloan | 132/210 |
| 5,823,204 | A | | 10/1998 | Todd | |
| 5,848,730 | A | | 12/1998 | Kawase | |
| 5,852,851 | A | * | 12/1998 | Cooper | 24/30.5 R |
| 5,971,645 | A | | 10/1999 | Fukushima | |
| 6,062,231 | A | | 5/2000 | De LaForcade | |
| 6,062,232 | A | * | 5/2000 | Johnson | 132/273 |
| 6,148,829 | A | | 11/2000 | De Benedictis | |
| 6,250,312 | B1 | | 6/2001 | Dasilva | |
| D458,129 | S | * | 6/2002 | Foster | D9/434 |
| 6,427,701 | B1 | | 8/2002 | Roth | |
| 6,440,175 | B1 | | 8/2002 | Stanley | |
| 6,582,142 | B2 | * | 6/2003 | Keller et al. | 401/11 |
| 6,626,599 | B2 | | 9/2003 | De Laforcade | |
| 6,638,133 | B1 | * | 10/2003 | Brancolino et al. | 446/73 |
| 6,748,957 | B1 | | 6/2004 | Giordano | |
| 6,991,118 | B2 | * | 1/2006 | Phillips | 211/85.3 |
| 7,011,097 | B2 | * | 3/2006 | Srivastava | 132/200 |
| 7,025,069 | B2 | | 4/2006 | Thiebaut | |
| 7,198,049 | B2 | | 4/2007 | Elmer | |
| 7,249,991 | B1 | * | 7/2007 | Watson | 446/220 |
| D555,833 | S | * | 11/2007 | Stotts | D28/10 |
| 7,357,137 | B2 | | 4/2008 | Husband | |
| 7,380,371 | B2 | * | 6/2008 | Jones et al. | 47/44 |
| 7,425,220 | B2 | | 9/2008 | Barrass | |
| 7,475,688 | B2 | | 1/2009 | Colacioppo | |
| 7,543,591 | B1 | | 6/2009 | Munsil | |
| 7,640,939 | B2 | | 1/2010 | Ploix | |
| 7,677,525 | B2 | * | 3/2010 | Sanchez et al. | 248/690 |
| 7,752,768 | B2 | * | 7/2010 | Young | 33/512 |
| D674,550 | S | * | 1/2013 | Sheppard et al. | D28/48 |
| 8,616,222 | B2 | * | 12/2013 | Baker et al. | 132/200 |
| 2002/0114657 | A1 | | 8/2002 | Gueret | |
| 2002/0142027 | A1 | | 10/2002 | Gueret | |
| 2002/0197228 | A1 | | 12/2002 | Lasala | |
| 2003/0007825 | A1 | | 1/2003 | De LaForcade | |
| 2003/0188759 | A1 | * | 10/2003 | Srivastava | 132/210 |
| 2004/0016064 | A1 | | 1/2004 | Vena | |
| 2004/0031502 | A1 | | 2/2004 | Winckels | |
| 2004/0089316 | A1 | | 5/2004 | Hamilton | |
| 2004/0182408 | A1 | | 9/2004 | De LaForcade | |
| 2005/0079192 | A1 | | 4/2005 | Simon | |
| 2005/0207153 | A1 | | 9/2005 | Leleve | |
| 2005/0211599 | A1 | | 9/2005 | De LaMettrie | |
| 2006/0042643 | A1 | | 3/2006 | Delan | |
| 2006/0064824 | A1 | | 3/2006 | Godfrey | |
| 2006/0065280 | A1 | * | 3/2006 | Cheung | 132/201 |
| 2006/0090771 | A1 | | 5/2006 | Ramet | |
| 2006/0144415 | A1 | | 7/2006 | Magee | |
| 2006/0207036 | A1 | | 9/2006 | Kennedy | |
| 2007/0144550 | A1 | | 6/2007 | Roher | |
| 2007/0215170 | A1 | | 9/2007 | Kennedy | |
| 2007/0227620 | A1 | | 10/2007 | Kunii | |
| 2008/0000492 | A1 | | 1/2008 | Mills | |
| 2008/0083418 | A1 | | 4/2008 | Glenn | |
| 2008/0083419 | A1 | | 4/2008 | Glenn | |
| 2008/0083420 | A1 | | 4/2008 | Glenn | |
| 2008/0087292 | A1 | | 4/2008 | Abergel | |
| 2008/0087293 | A1 | | 4/2008 | Glenn | |
| 2008/0087294 | A1 | | 4/2008 | Glenn | |
| 2008/0110929 | A1 | | 5/2008 | Stanley | |
| 2008/0156817 | A1 | | 7/2008 | Roseblade | |
| 2008/0196734 | A1 | | 8/2008 | Husband | |
| 2008/0223386 | A1 | | 9/2008 | Albisetti | |
| 2008/0223391 | A1 | | 9/2008 | Baker | |
| 2008/0223393 | A1 | | 9/2008 | Boyle | |
| 2008/0257370 | A1 | | 10/2008 | Perry | |
| 2008/0308119 | A1 | | 12/2008 | Smith | |
| 2009/0050171 | A1 | | 2/2009 | Barrass | |
| 2009/0071496 | A1 | | 3/2009 | Glenn | |
| 2009/0084393 | A1 | | 4/2009 | Baker | |
| 2009/0084394 | A1 | | 4/2009 | Baker | |
| 2009/0084395 | A1 | | 4/2009 | Glenn | |
| 2009/0095314 | A1 | | 4/2009 | Lund | |
| 2009/0101159 | A1 | | 4/2009 | Bonnafous | |
| 2009/0152281 | A1 | | 6/2009 | Bowes | |
| 2009/0223531 | A1 | | 9/2009 | Lund | |
| 2013/0276807 | A1 | * | 10/2013 | Teater Makinen | 132/201 |
| 2013/0291352 | A1 | * | 11/2013 | Earley, III | 24/545 |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |

(56) References Cited

FOREIGN PATENT DOCUMENTS

| | | | |
|---|---|---|---|
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 10290712 | A | 11/1998 |
| JP | 11-178630 | | 7/1999 |
| JP | 11-178639 | A | 7/1999 |
| JP | 2001-211925 | A | 8/2001 |
| JP | 2001523500 | A | 11/2001 |
| JP | 2002-034636 | A | 2/2002 |
| JP | 2003-199623 | A | 7/2003 |
| JP | 2003-310337 | A | 11/2003 |
| JP | 2004338725 | A | 12/2004 |
| JP | 2006043434 | A | 2/2006 |
| JP | 2006082852 | A | 3/2006 |
| JP | 3129205 | U | 2/2007 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

* cited by examiner

TOOL FOR SEPARATING A HAIR BUNDLE

FIELD OF THE INVENTION

The present invention relates to a tool for separating a hair bundle from the remaining hair. In particular, the present invention relates to a tool for aiding the separation of a hair bundle creating a number of hair strands appropriate for the application of a hair treatment composition for creating a hair bundle effect.

BACKGROUND OF THE INVENTION

Hair bundle effects such as highlighting and dyeing effects are a popular and conventional way of changing appearance. Although many devices and methods to apply hair treatment compositions to hair bundles are known in the art, performing the same by consumers at home remains difficult.

The level of instructions provided by manufacturers of consumers' products for imparting hair bundle effects is generally confined to how to mix and safely apply the hair treatment composition onto the hair. Some limited information is provided on where to apply the hair treatment composition on the hair by means of illustrations. However, very few details are given with regard to the appropriate number of hair strands to be selected to achieve the expected hair bundle effect as described or shown in the illustrations.

The cap and hook system for creating highlighting is well known in the art. The cap (2) is provided with holes as shown in FIG. 1. The cap (2) is positioned tightly over the hair and the scalp; a hair bundle (11) is then selected by pulling out the hair bundle (11) through the hole with a hook (3). This step is repeated for a plurality of hair bundles. The selected hair bundles are then treated with a highlighting composition. The cap and hook system suffers from several drawbacks. First, the process of pulling the hair bundles through the holes in the cap is painful. Second, the choices as to the location of the hair bundle to be treated are limited to where the holes are in the cap. Thirdly, the process of pulling the hair bundles through the holes can lead to unexpected end results, because the hair bundle pulled through the hole does not necessarily come from the scalp directly below the hole. In addition, the repetitive use may deform the holes of the cap but not uniformly and thus, the cap may not reliably provide for a constant size of the hair bundles pulled through the holes.

Some alternatives to the cap and hook system are proposed in FR2444421, U.S. Pat. No. 3,921,647 and FR2495905. Nevertheless, none of these disclosures provide a means that may be used not only for keeping a hair bundle separated from the remaining hair, but also for aiding the selection of a hair bundle comprising a number of hair strands appropriate for creating hair bundle effects, especially highlighting effects as provided at professional salons. Professional stylists create highlighting effects only using foils and their experience. At home, consumers in the absence of the technical expertise of professional stylists are left alone to decide, select and separate hair bundles for creating a highlighting effect corresponding to the expected final look. The lack of information and experience may lead to inconsistent results and user dissatisfaction.

Accordingly, it is desirable to provide an easy to apply, light, comfortable and cheap to manufacture means for separating a hair bundle from the remaining hair, without special training, wherein the selected hair bundle comprises a number of hair strands appropriate for highlighting.

SUMMARY OF THE INVENTION

The present invention provides a solution to the above described technical problem in a first aspect by means of a tool (1) for separating a hair bundle (11) from the remaining hair, the tool (1) comprising:

a. an external surface (100);

b. a through hole (10) within the tool (1) for receiving the hair bundle (11), wherein the through hole (10) defines on the external surface (100) an upper rim (12) and a lower rim (13); the through hole (10) further defines within the tool (1) an internal surface (200);

c. a slit (50) for inserting the hair bundle (11) into the through hole (10), the slit (50) extending from the external surface (100) through the tool (1) and opening into the through hole (10);

wherein the slit (50) defines on the external surface (100) a first slit edge (51) and a second slit edge (52); wherein both the first and the second slit edges (51; 52) join the upper rim (12) and the lower rim (13) of the through hole (10) such that the slit (50) extends from the upper rim (12) to the lower rim (13) of the through hole (10); and wherein the slit (50) defines within the tool (1) a first slit face (501) and a second slit face (502) and wherein the first slit face (501) has a slit distance (d) from the second slit face (502).

In a second aspect, the invention herein disclosed solves the above technical problem by means of an implement (14) comprising a plurality of tools (1; 1'), wherein each of the plurality of tools (1; 1') is attached to the implement (14).

The present invention also relates to a method for imparting hair bundle effects whereby a hair bundle (11) is selected and subsequently separated from the remaining hair by applying the tool (1) according to the present invention. The present invention further relates to a kit (60) for imparting hair bundle effects comprising at least one tool (1) according to the invention and a hair treatment composition (15).

DETAILED DESCRIPTION OF THE INVENTION

The invention will now be described in more detail with reference to component parts of the tool, first in general terms and then with reference to specific embodiments.

Definitions

For the purpose of this invention, the term "hair" refers to both living hair, i.e. on a living body and to non-living hair, i.e. in a wig, hair piece or other aggregation of non-living keratinous strands. Mammalian, preferably human hair is intended.

By "hair bundle" is meant at least two hair strands.

By "hair bundle effect" is meant an effect created on a plurality of independent hair bundles rather than on a full head. The effect may be a lighter or lower tone of the hair bundles than the remaining hair, a different colour or different styles such as curling or frizzing.

For the purpose of this invention, the term "extend upon" is used to indicate where the feature is located and not the act of locating it.

Tool

Figure 1:
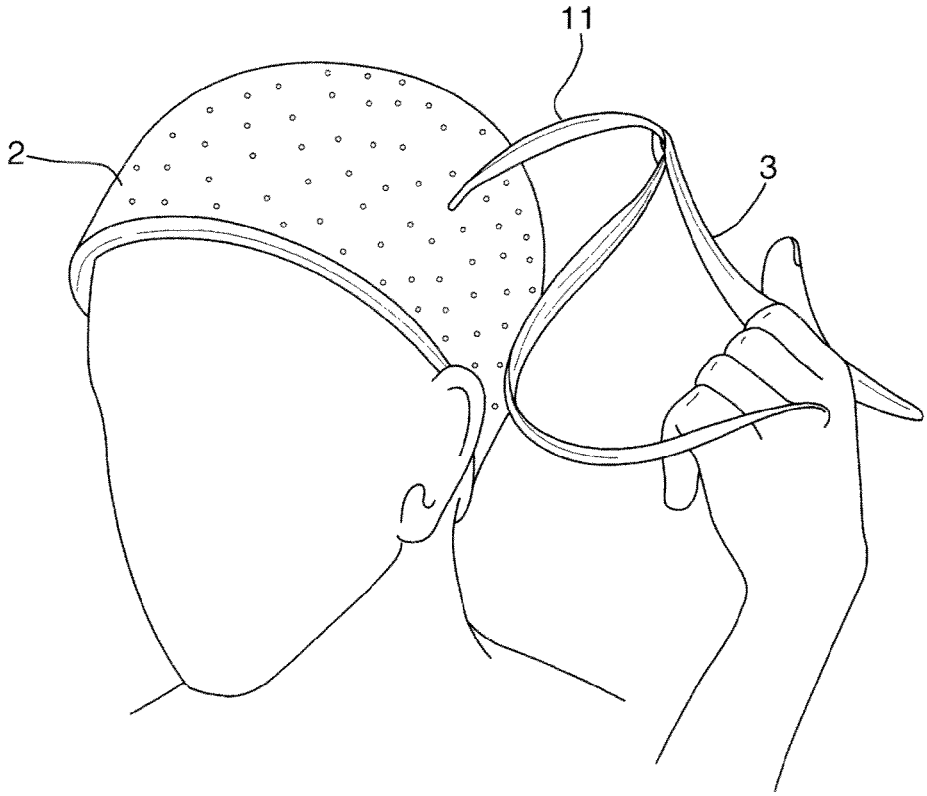
Fig.1. (Prior Art)
FIG. 1 illustrates an embodiment of the prior art for highlighting hair using the cap and hook system.
Figure 2A:
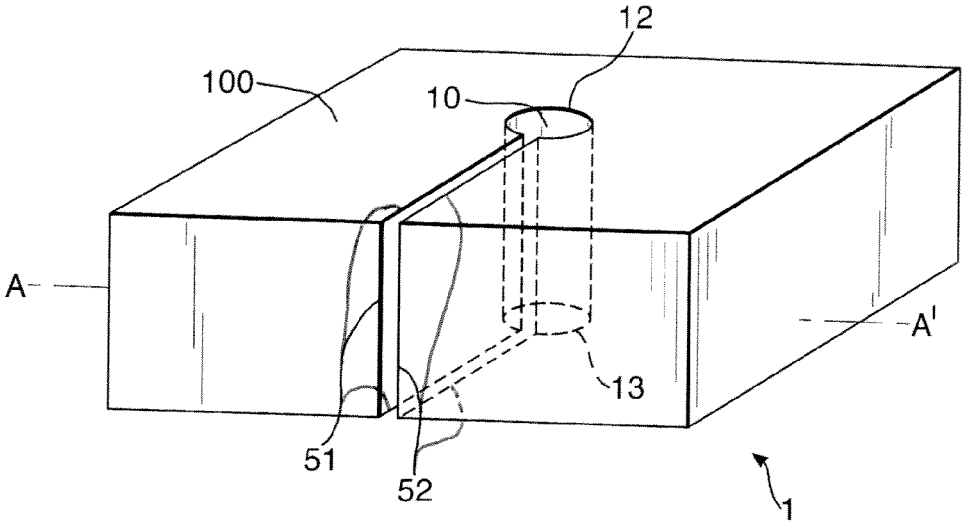
FIG. 2A is a perspective view of one embodiment of the tool (1) having a parallelepiped form.
Figure 3A:
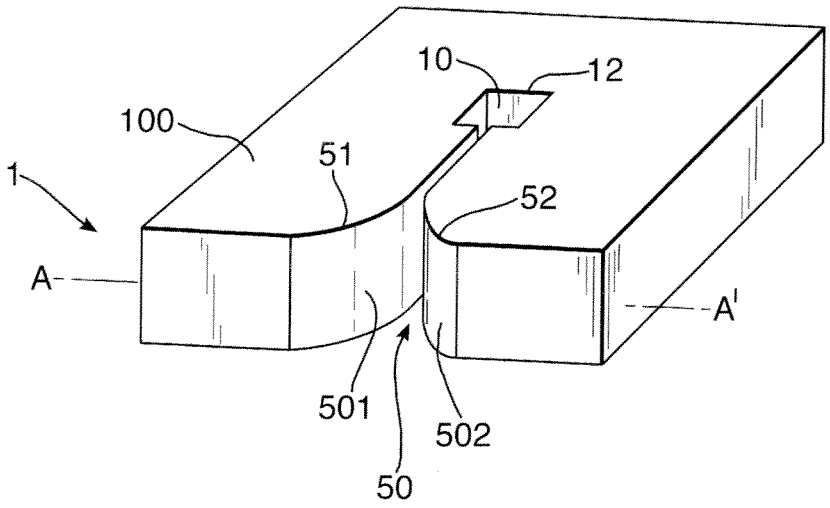
FIG. 3A is a perspective view of one embodiment of the tool (1) having divergent first and second slit faces (501; 502).
Figure 4:
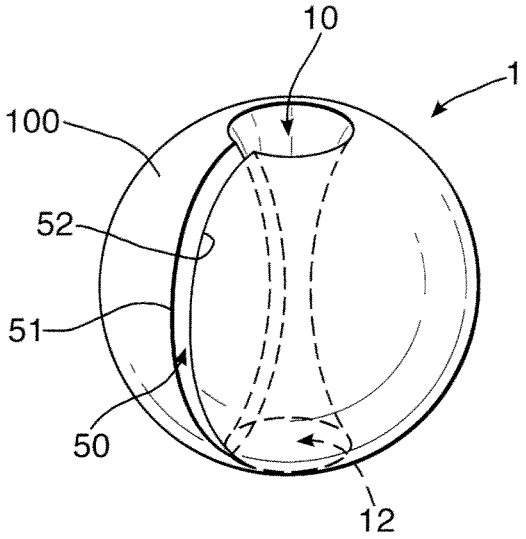
FIG. 4 is a perspective view of an embodiment of the tool (1) having a spherical shape and an hour glass shaped through hole (10).

The tool (1) according to the invention comprises an external surface (100) as shown in FIGS. 2A, 3A and 4. The tool (1) is manufactured of a material which is preferably compatible and inert to hair treatment compositions comprising reactive agents such as hydrogen peroxide and persulfate salts during its use. Suitable materials are polymer resins such as a polyolefin, including polypropylene, polyethylene or polyethylene terephthalate. Other polymers which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials. Other materials that could be used include porous foams and foam materials. Porous foams and foam materials are made from low density elastomers, plastics, and other materials with various porosities and may be selected from open cellular foams; flexible foams; rigid foams; reticular foams and syntactic foams. The porous foams and foam materials may be composed of a variety of chemical systems including acrylonitrile-butadiene-styrene (ABS); acrylics; epoxy resins; fluoropolymers; isoprene-styrene (SIS) and styrene-butadiene-styrene (SBS); synthetic rubbers or elastomers based on a variety of systems such as silicone, polyurethane and neoprene; nitrile rubbers; plastics or elastomers formed from natural or plant-based raw materials such as natural rubber (polyisoprene) or vulcanized fibre; water-based and water-borne resins and latex materials. Chemical systems for porous foams and foam materials may include ethylene copolymer, expanded polyethylene, polycarbonate, polyester, polyether, polyetherimide, polyimide, polyolefin, polypropylene, polyurethane, phenolic, polyurea, and vinyl. Combinations of the aforementioned materials may also be used. Preferably, the tool (1) is made of polyolefins, paper board or combinations thereof. The tool (1) may be manufactured by injection moulding, co-injection moulding, over moulding, in-mold assembly, compression moulding, blow moulding, thermo or vacuum forming of a blister type shell and lamination onto a carrier plastic or board material in the horizontal or vertical plane. Porous foams and foam materials can be fabricated into finished shapes using molding, casting, extrusion, pultrusion, machining, thermal forming, plastic welding, blow molding, rapid prototyping techniques, grinding and/or other specialized processes. The tool (1) can also be cut; laser cut; punched or stamped out of a sheet of material.

The tool (1) is preferably manufactured of a flexible and/or elastic material. The tool (1) is preferably moulded in a single piece or only one material but it may also comprise workpieces from two or more materials in a common moulding operation as described above. The tool (1) according to the invention may be hollow.

Preferably, the tool (1) according to the present invention does not comprise any hinged or movably joined portions. Without wishing to be bound by theory it is believed that a tool (1) manufactured by a flexible and/or elastic material and absent of movably joined and/or hinged portions reduces the complexity and the costs of manufacture; in addition it facilitates consumers in both holding and applying the tool (1) onto the hair bundle (11) without having to adjust the movably joined and/or hinged portions prior to application onto the hair bundle.

Figure 6:
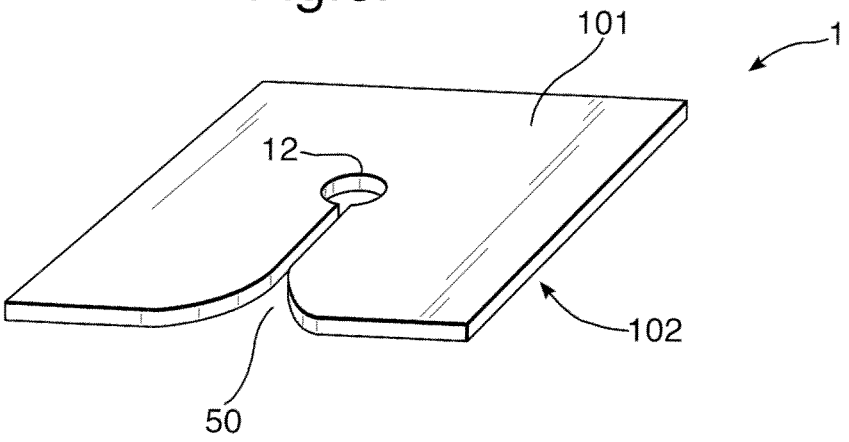
FIG. 6 is a perspective view of an embodiment of the tool (1), wherein the tool is substantially flat.

The tool (1) may have various forms. A spherical form is shown in FIG. 4, but also other forms including asymmetric forms may be selected. The tool (1) is preferably of limited dimensions in order to occupy, when applied, a limited portion of the length of the hair bundle (11) to be treated with the hair treatment composition (15). In a preferred aspect of the present invention, the tool (1) is substantially flat as shown in FIG. 6. When the tool (1) is substantially flat, the external surface (100) of the tool (1) is divided in to a first surface (101) and a second surface (102). Preferably, each of the first and second surfaces (101; 102) independently has an area of from about 1.5 $cm^2$ to about 15 $cm^2$, more preferably the first and second surfaces (101; 102) have substantially identical area. Without wishing to be bound by theory it is believed that when the tool (1) is substantially flat it may additionally protect the scalp from spillages of hair treatment composition (15).

Through Hole

Figure 2B:
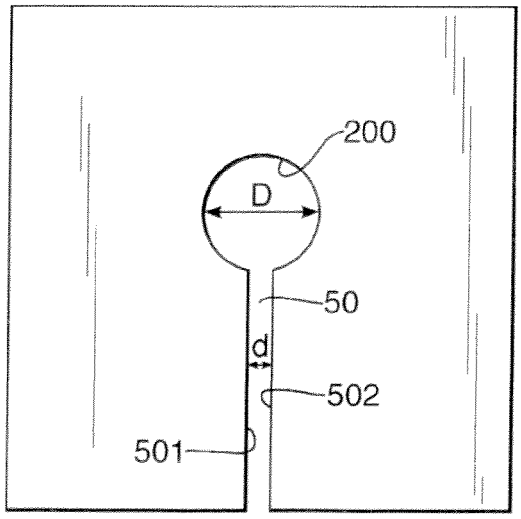
FIG. 2B is a cross-sectional view along axis A-A' of the embodiment shown in FIG. 2A.
Figure 3B:
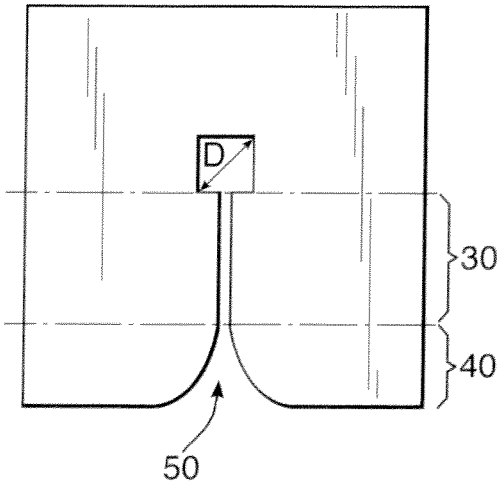
FIG. 3B is a cross-sectional view along axis A-A' of the embodiment shown in FIG. 3A.
Figure 5:
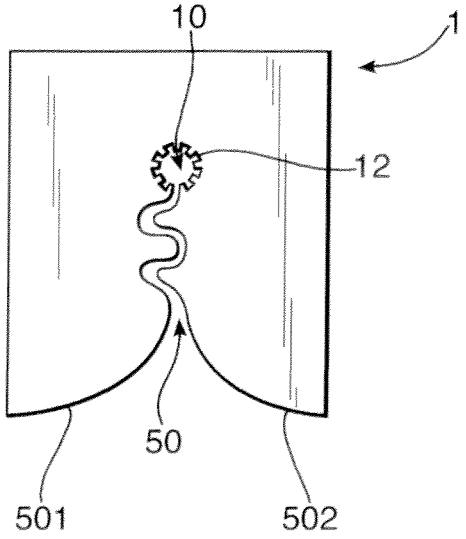
FIG. 5 is a top view of an embodiment of the tool (1) showing a crenellated shape of the upper rim (12).

The tool (1) of the present invention comprises a through hole (10). The through hole (10) defines on the external surface (100) an upper rim (12) and a lower rim (13) as shown in FIG. 2A; the through hole (10) further defines within the tool (1) an internal surface (200) as shown in FIG. 2B. When the tool (1) is substantially flat as described above, the through hole (10) defines the upper rim (12) on the first surface (101) and the lower rim (13) on the second surface (102). The upper and lower rims (12; 13) may be substantially identical or they may be different in shape and/or in length. The shape of the upper and/or lower rims (12; 13) may be for example circular or squared as shown in FIGS. 2B and 3B, respectively. Other shapes such as a sinusoidal shape or a crenellated shape as shown in FIG. 5 may further aid to keep the tool (1) attached to the hair bundle (11). The through hole (10) has an average diameter (D) across its cross-section, wherein the cross section is taken perpendicular to the lengthwise dimension of the through hole (10) and wherein the lengthwise dimension is the dimension of the through hole (10) from the upper rim (12) to the lower rim (13). The average diameter (D) does not extend into the slit (50)

In one aspect of the present invention the through hole (10) is a uniform channel having a circular cross-section as shown in FIG. 2A. In another aspect of the present invention, the through hole (10) may not be uniform such as it comprises constrictions or may have an hour glass shape as shown in FIG. 4. In this aspect, the average diameter (D) of the through hole (10) is to be measured at the narrowest constriction. The constrictions may further promote holding of the tool (1) on the hair bundle (11). It should be understood that deviations from the circular, semicircular or oval section of the through hole (10) are also possible. For instance, if a through hole (10) has a square or rectangular cross-section perpendicular to its lengthwise dimension, the average diameter (D) is the diagonal of the squared or rectangular cross-section as shown in FIG. 3B.

Figure 7:
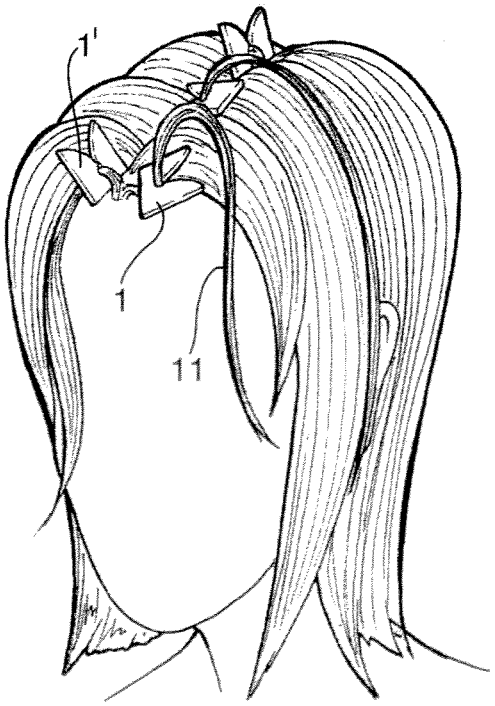
FIG. 7 shows a plurality of tools (1; 1') according to the invention located at the root-line of each selected hair bundle (11).

The through hole (10) not only receives and keeps a hair bundle (11) separated from the remaining hair as shown in FIG. 7, but it also dictates the number of hair strands of the hair bundle (11) to be selected. Only a hair bundle (11) comprising a limited number of hair strands can be received into the through hole (10). Inexperienced users may select hair bundles (11) comprising a number of hair strands which, if treated, would not correspond to the expected end results. The present inventors have found that by pre-determining the size of the through hole (10) in the tool (1), it is possible to select and keep separated from the remaining hair only a defined number of hair strands. For example, a tool (1) comprising a through hole (10) of circular cross-section having an average diameter (D) of about 1.5 mm may hold about 85 hair strands of Caucasian light brown hair (International Hair Imports and Products, Valhalla, N.Y.). Once that appropriate number of hair strands has been accommodated within the through hole (10), no additional hair strands can be received therein unless the tool (1) is torn apart or the through hole (10) is forced to enlarge. Those hair strands which are not received within the through hole (10) are not kept separated from the remaining hair.

The average diameter (D) of the through hole (10) is preferably from about 0.5 mm to about 4 mm, more preferably from about 1 mm to about 3.5 mm. Considering the variation of the hair strand diameter across different hair types, the hair bundle (11) comprises from about 15 to about 500 hair strands, preferably from about 20 to about 250, more preferably from about 25 to about 150 hair strands. Thus, by varying the size of the average diameter (D) of the through hole (10), it is possible to select hair bundles (11) for creating a variety of hair bundle effects, from natural colour variations to bold effects.

Slit

The tool (1) further comprises a slit (50). The slit (50) is the passageway for the selected hair bundle (11) to the through hole (10). The slit (50) extends from the external surface (100) of the tool (1), within the tool (1) itself, to the through hole (10) as shown in FIGS. 2A and 4. The slit (50) can be made either directly during the manufacturing of the tool (1) or after a gripping layer (70), as described herein after, has been fixed to the tool (1). The slit (50) can be formed by mechanical cutting, laser cutting, punching or stamping the slit (50) itself through the tool (10). The slit (50) defines on the external surface (100) a first slit edge (51) and a second slit edge (52) as shown in FIG. 2A. Both the first and second slit edges (51; 52) extend from the upper rim (12) to the lower rim (13) so that the slit (50) itself also extends from the upper and lower rims (12; 13). As described above for the upper and lower rims (12; 13), also the first and second slit edges (51; 52) may be substantially identical or different in shape and length. Clearly, their shape and length depends on the form of the tool (1) itself and on the degree of symmetry within the tool (1). Asymmetric tools (1) are not excluded herein; on the contrary they may be preferred if facilitating the holding of the tool (1) by consumers.

The slit (50) defines within the tool (1) a first slit face (501) and a second slit face (502) as shown in FIGS. 2B and 3A. The first and second slit faces (501; 502) may be curved or substantially flat. In addition, the first and second slit faces (501; 502) may preferably diverge along their lengthwise dimensions, wherein the lengthwise dimension of the first and second slit faces (501; 502) is taken perpendicularly to the lengthwise dimension of the through hole (10). The first slit face (501) has a slit distance (d) from the second slit face (502) as shown in FIG. 2B. In one aspect of the present invention the first and second slit faces (501; 502) independently may be substantially flat or may have one or more grooves. In another aspect of the present invention the first and/or second slit faces (501; 502) may have a waved surface as shown in FIG. 5. In yet another aspect of the present invention, the first and the second slit faces (501; 502) may form in the tool (1) a neck portion (30) and an accessing portion (40) as shown in FIG. 3B. The neck portion (30) is proximal to the through hole (10) and the internal surface (200) of the tool (1). In one aspect of the present invention, the slit distance (d) in the accessing portion (40) increases as the first and the second slit faces (501; 502) diverge. The ratio of the slit distance (d) between the first and second slit faces (501; 502) in the neck portion (30) and in the accessing portion (40), respectively, is below about 1. Preferably, it is below about 0.75, more preferably it is below about 0.5. The slit distance (d) between the first and second faces (501; 502) in the neck portion (30) is constant and about 2 mm or less, more preferably about 1.5 mm or less, even more preferably about 1 mm or less.

The first and the second slit faces (501; 502) in the accessing portion (40) of the tool (1) are preferably curved. More preferably the first slit face (501) diverges in the accessing portion (40) from the second slit face (502). Without wishing to be bound by theory it is believed that when the tool (1) has divergent first and second slit faces (501; 502) in the accessing portion (40), the selection and the separation of a hair bundle (11) is further enhanced. Hair strands which have not been received within the through hole (10) may be caught or entrapped between the first and second slit faces (501; 502). This may be obviated by having divergent first and second slit faces (501; 502) in the accessing portion (40). Non-divergent first and second slit faces (501; 502) are instead preferred in the neck portion (30) to further ensure that the hair bundle (11) is kept separated from the remaining hair and that the tool (1) is held onto the hair bundle (11).

Gripping Layer

Figure 8:
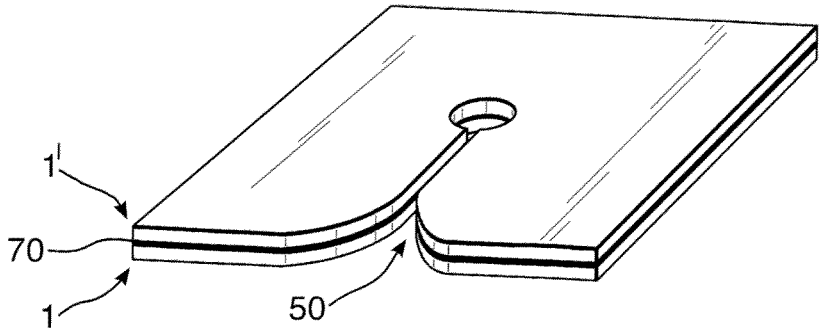
FIG. 8 shows an embodiment of the tool (1) wherein the gripping layer (70) is embedded between two substantially identical and substantially flat tools (1; 1').
Figure 9:
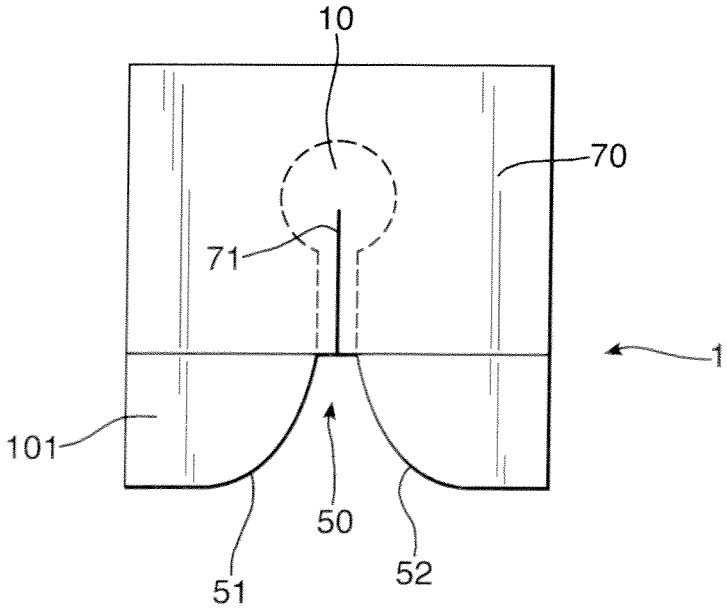
FIG. 9 shows a top view of an embodiment of the tool (1) wherein the gripping layer (70) extends upon the through hole (10) and the neck portion (30).
Figure 10:
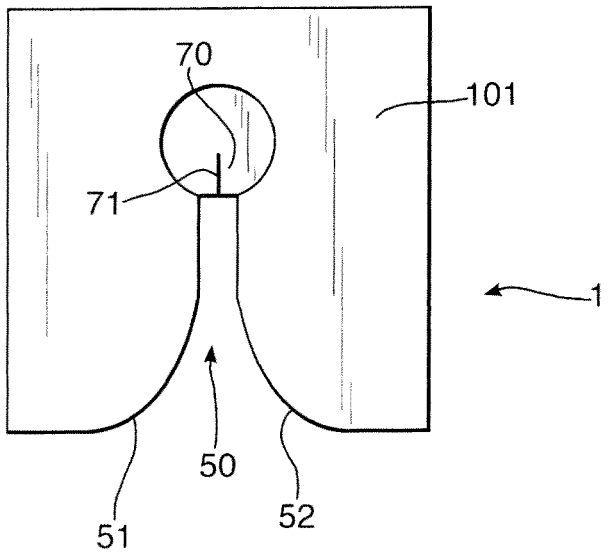
FIG. 10 shows a top view of an embodiment of the tool (1) wherein the gripping layer (70) extends upon the through hole (10).

A gripping layer (70) may extend upon at least a portion of the external surface (100) of the tool (1), of the internal surface (200), of the first and second slit faces (501; 502) or of combinations thereof. In addition, the gripping layer (70) may also be independently arranged to partially or completely extend upon the through hole. When the gripping layer (70) extends upon at least a portion of the through hole (10), that gripping layer (70) comprises a cut (71), preferably the cut (71) is arranged as to align with the slit (50) of the tool (1) as shown in FIGS. 9 and 10. In another aspect of the present invention, the gripping layer (70) may create a constriction projecting from the internal surface (200) of the through hole (10) as described above. In another aspect of the present invention, the gripping layer (70) may be embedded between two tools (1; 1'), wherein the two tools (1; 1') are preferably substantially flat as shown in FIG. 8.

The gripping layer (70) can be manufactured from any known material or combination of materials suitable for use with hair treatment compositions (15) and which can grip the hair bundle (11). Examples include, but are not limited to, thermo plastic elastomers, rubbers such as neoprene and nitrile, latex, vulcanised (thermo-set) and polyolefins, silicone rubbers and porous foams and foam materials as described earlier.

The gripping layer (70) may be fixed to the tool (1) by co-injection moulding, over moulding, in-mould assembly, printing, gluing, ultrasonic welding, staking and heat welding.

Without wishing to be bound by theory it is believed that the presence of a gripping layer (70) on at least a portion of the tool (1) or within the through hole (10) may enhance the grip of the tool (1) to the selected hair bundle (11). In addition, in view of its deformable nature, the gripping layer may shape around the selected hair bundle (11). This results in a barrier for the hair treatment composition (15) and avoids the leaking of the latter onto the scalp.

DESCRIPTION OF PREFERRED EMBODIMENTS

The following embodiments are directed to a tool (1) for separating a hair bundle (11) from the remaining hair.

Figure 11A:
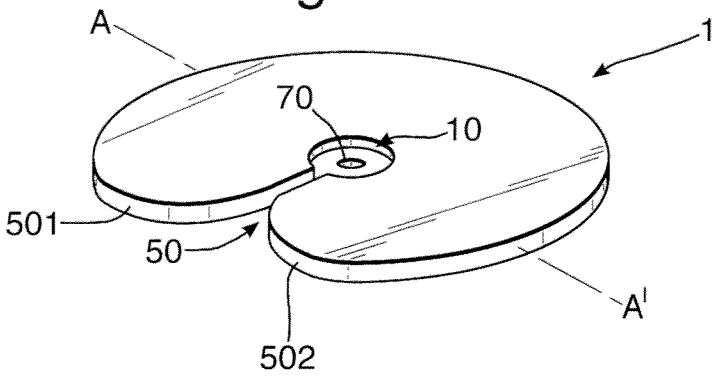
FIG. 11A illustrates a perspective view of an embodiment of the tool (1) having curved and divergent first and second slit faces (501; 502) in the accessing portion (40).
Figure 11B:
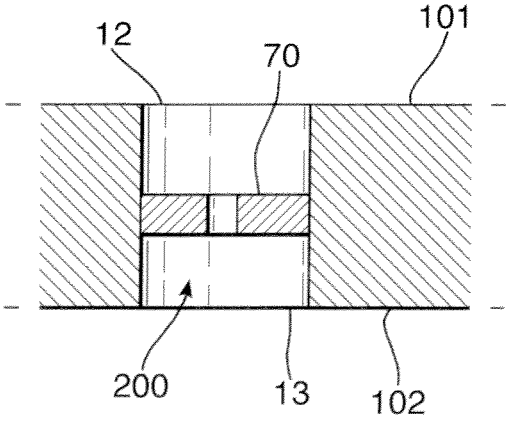
FIG. 11B shows a longitudinal cross-section along axis A-A' across the through hole (10) of the embodiment illustrated in FIG. 11A.
Figure 11C:
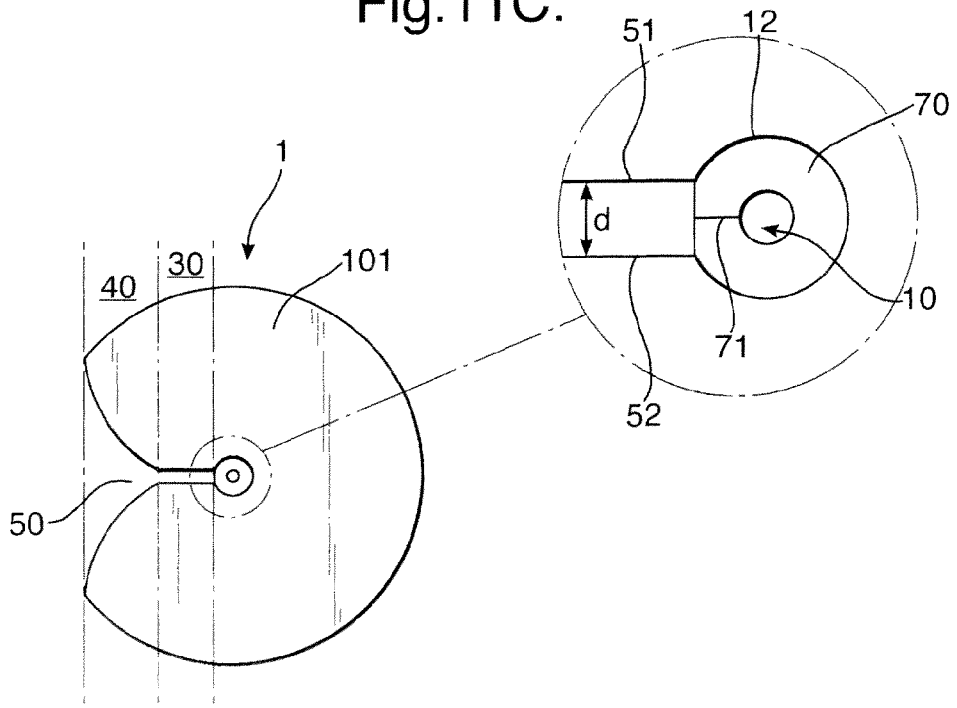
FIG. 11C shows a top view of the embodiment illustrated in FIG. 11A.

FIG. 11A illustrates a first embodiment of the tool (1) according to the invention. The tool (1) is substantially flat. The gripping layer (70) partially extends upon a portion of the through hole (10) of the tool (1). In this embodiment, the gripping layer (70) projects from the internal surface (200) of the through hole (10), transversally to the lengthwise dimension of the through hole (10) itself as shown in FIG. 11B. The through hole (10) in this embodiment is an uniform channel with a circular cross-section and the gripping layer (70) has the form of a ring. A cut (71) is provided in the gripping layer (70) as shown in FIG. 11C to allow the selected hair bundle (11) to be received into the through hole (10) from the slit (50). The first and second slit faces (501; 502) of the slit (50) are curved and divergent in the accessing portion (40) as shown in FIG. 11C while they are parallel and at a constant slit distance (d) in the receiving portion (30).

Figure 12:
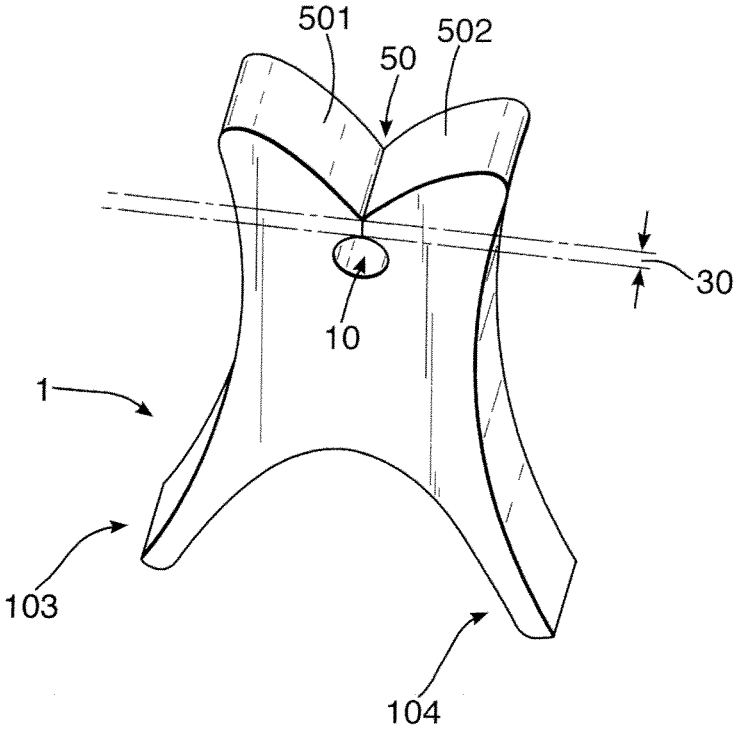
FIG. 12 is a perspective view of an embodiment of the tool (1) having a spring clip shape.

FIG. 12 shows another embodiment of the tool (1) according to the invention. The form of the tool (1) represented in this embodiment is free of movably joined portions or hinges. The tool (1) comprises a first protrusion (103) and a second protrusion (104) on the portion of the tool (10) opposite to where the accessing portion (40) and the neck portion (30) are located. The embodiment of the tool (1) shown in FIG. 12 is preferably manufactured from a foam material. In view of the elastic nature of the material used for manufacturing the tool (1), it is possible to compress and bring closer with the thumb and index fingers the first and second protrusions (103; 104) of the tool (1). A tension is created within the tool (1) itself which translates in the separation of the first and second slit faces (501; 502) in the neck portion (30) of the tool (1), in the absence of a hinge. This separation further facilitates the entrance of the hair bundle (11) within the through hole (10).

Figure 13:
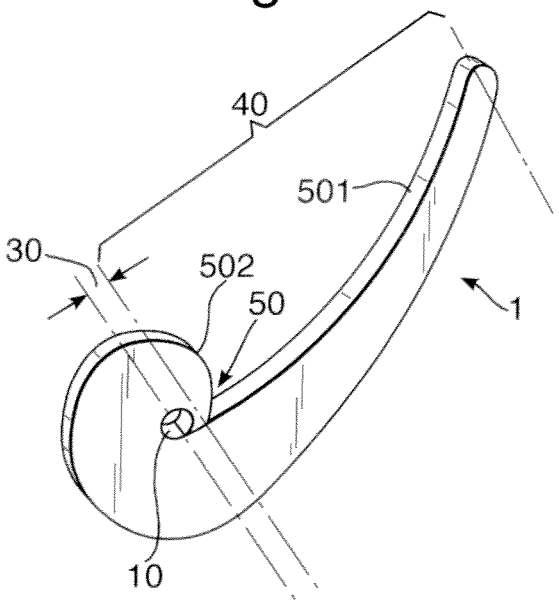
FIG. 13 is a perspective view of an embodiment of the tool (1) having an asymmetric form.

FIG. 13 shows an embodiment of a tool (1) according to the invention, wherein the tool (1) has an asymmetric form. The first slit face (501) is extended while the second slit face (502) is short. Although both the first and the second slit face (501; 502) are curved in the accessing portion (40), their curvature is substantially different.

Figure 14:
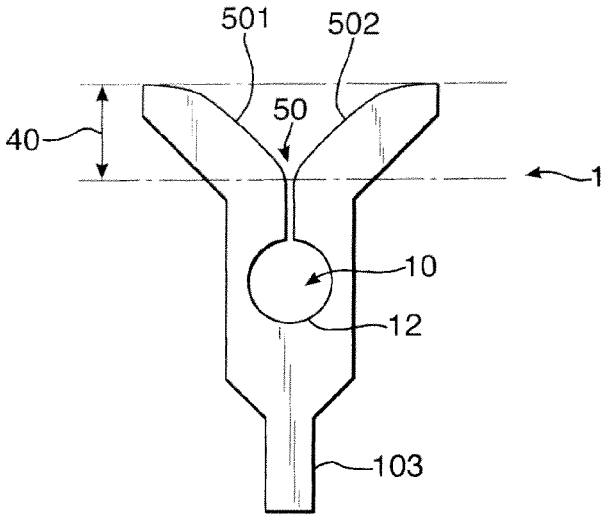
FIG. 14 is a top view of an embodiment of the tool (1) having divergent and curved first and second slit faces (501; 502).
Figure 15A:
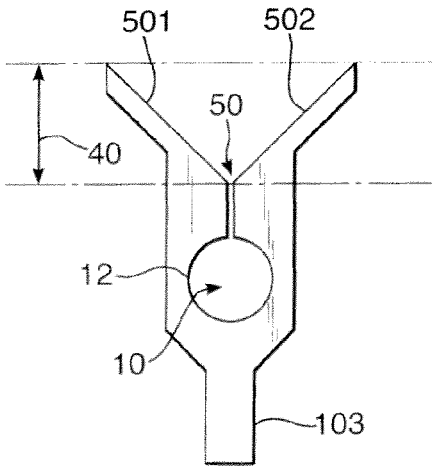
FIG. 15A is a top view of an embodiment of the tool (1) having divergent and substantially flat first and second slit faces (501; 502).
Figure 15B:
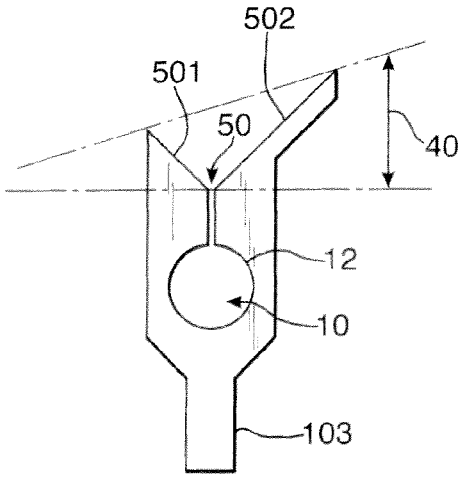
FIG. 15B is a top view of an asymmetric variation of the embodiment shown in FIG. 15A.

FIG. 14 shows a top view of an embodiment of the tool (1) according to the invention which comprises a first protrusion (103) on the portion of the tool (1) opposite to where the accessing portion (40) and the neck portion (30) are located. The first protrusion (103) is useful for holding the tool (1) while the latter is being put in place. Its presence, furthermore, eases the removal of the tool (1) from the hair bundle (11). The same feature is also shown in the embodiments represented in FIGS. 15A and 15B. The tool (1) of the embodiments illustrated in FIGS. 14, 15A and 15B have a substantially elongated form. The tool (1) illustrated in FIGS. 14 and 15A has divergent first and the second slit faces (501; 502) in the accessing portion (40). The first and second slit faces (501; 502) can be either curved as shown in the embodiments of FIG. 14 or substantially flat as shown in the embodiment of FIG. 15A. A variation of the embodiments of FIGS. 14 and 15A is shown in FIG. 15B, wherein the tool (1) comprises asymmetry in the accessing portion (40).

Figure 16:
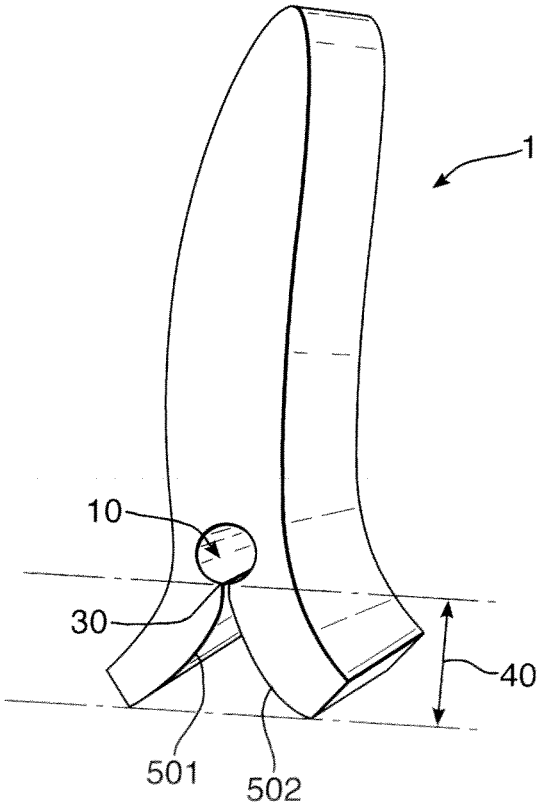
FIG. 16 is a perspective view of an embodiment of the tool (1) having elongated form.

The tool (1) illustrated in FIG. 16 also shows an elongated form. The first and the second slit faces (501; 502) are substantially divergent in the accessing portion (40) and the neck portion (30) is substantially reduced to where the first and second slit faces (501; 502) come into a juxtaposed relationship.

Figure 17A:
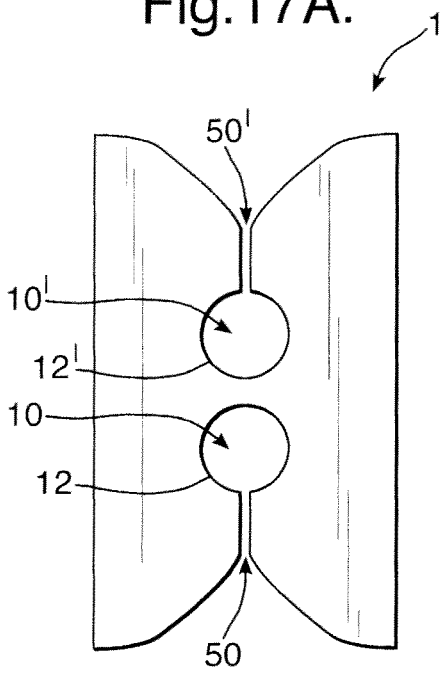
FIG. 17A is a top view of an embodiment of the tool (1) comprising two substantially identical through holes (10; 10').
Figure 17B:
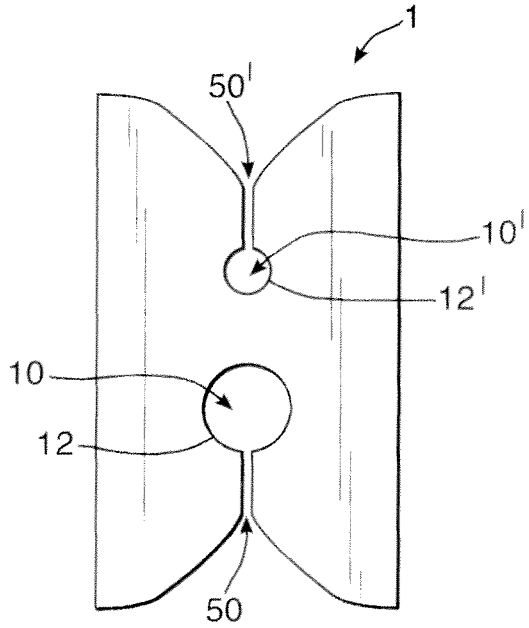
FIG. 17B is a top view of an embodiment of the tool (1) comprising two substantially different through holes (10; 10').

The tool (1) according to the invention shown in the embodiments illustrated in FIGS. 17A and 17B is substantially flat. These embodiments of the tool (1) comprise a first through hole (10) and a second through hole (10') within the same tool (1). The access to the first through hole is provided by the first slit (50) and the access to a second through hole (10') is provided by the second slit (50'). The size of the first through hole (10) and of the second through hole (10') may be substantially identical as shown in FIG. 17A or substantially different as shown in FIG. 17B. Substantially different through holes (10; 10') within the same tool (10) may increase the flexibility for the consumers when using the tool (1) according to the invention. As described above, the size of the through hole (10) dictates the number of hair strands comprised within the hair bundle which can be separated by means of the tool (1) described herein. Treatment with a hair treatment composition (15) of a hair bundle composed of about fifty hair strands provides for a final result which is different if the bundle was composed of about five hundred or more hair strands.

Implement

Figure 19:
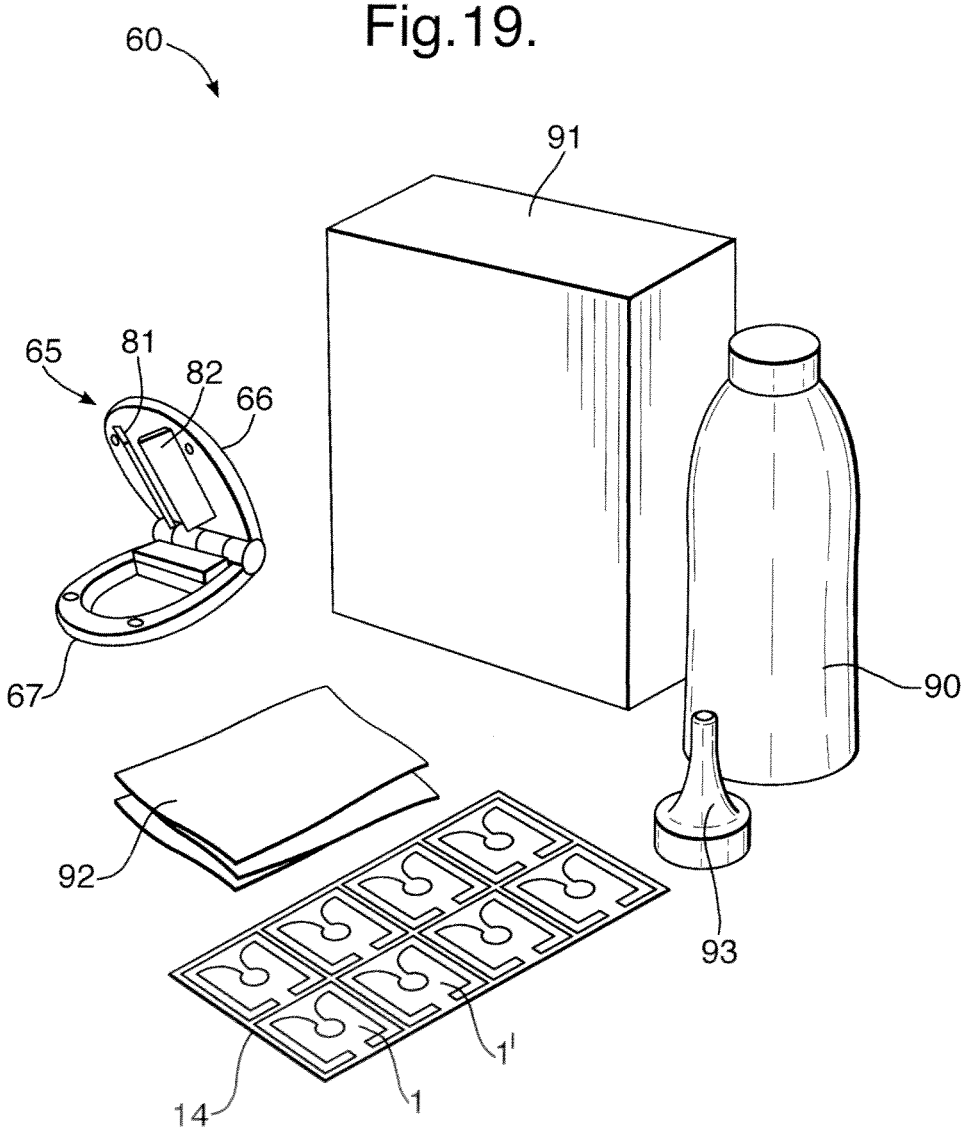
FIG. 19 is a schematic view of a kit (60) for imparting a hair bundle effect comprising the tool (1) according to the invention.
Figure 21A:
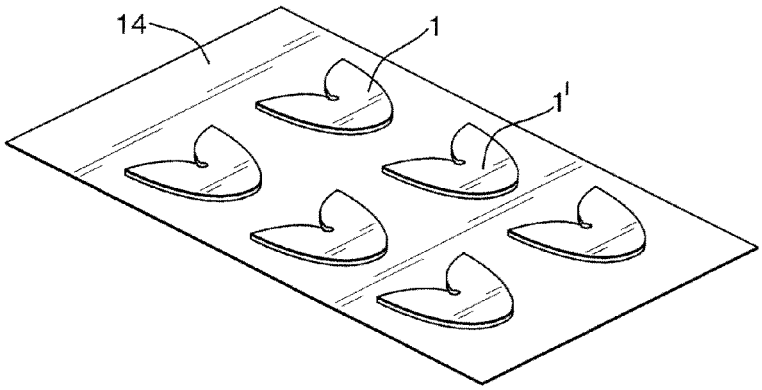
FIG. 21A shows an embodiment of the implement (14) according to the invention, wherein the plurality of tools (1; 1') are chemically attached to the implement (14).

The present invention further relates to an implement (14). The implement (14) comprises a plurality of tools (1; 1'), wherein each tool of the plurality of tools (1; 1') is independently attached to the implement (14). The tools (1; 1') may be chemically and/or mechanically attached to the implement (14). The tools (1' 1') may be chemically attached by means of adhesives, for example a hot melt adhesive. The tools (1; 1') may be mechanically attached by interlocking. Preferably the tools (1; 1') of the plurality of tools (1; 1') attached to the implement (14) are substantially flat. In one aspect, the implement (14) is a sheet of material and the tools (1' 1) are attached to the surface of the sheet of material by means of an adhesive as shown in FIG. 21A. The sheet of material may be included, but it is not limited to, one page of the instructions (92) as described herein after. In another aspect illustrated at FIG. 21B, the implement (14) is a cardboard sheet and the plurality of tools (1; 1') are punctured through the cardboard sheet. Each tool (1; 1') is then excised from the cardboard sheet when needed. The cardboard sheet may include, but it is not limited to, the package (91) of a kit (60) as described herein after. In yet another aspect shown in FIG. 19, the implement (14) is a sheet of material selected from the group consisting of polyolefins, foams, paperboard and combinations thereof. Each tool (1; 1') of the plurality of tools (1; 1') comprises one or more protrusions (103; 104). At least one of the protrusion connects the tool (1; 1') to the implement (14), preferably the implement (14) and the plurality of tools (1; 1') are moulded in a single piece and then cut to create an implement (14) comprising a plurality of tools (1; 1'). An embodiment of the latter aspect of the invention is shown in FIG. 19.

Method

The present invention further relates to a method for imparting hair bundle effects by selecting a hair bundle (11) and subsequently applying the tool (10) according to the present invention.

Figure 18A:
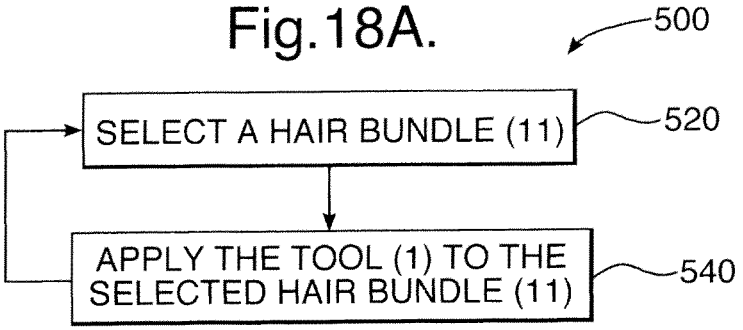
FIG. 18A is a flowchart illustrating an embodiment of a method (500) for imparting hair bundle effects according to the present disclosure.

FIG. 18A illustrates a flowchart of an embodiment of a method (500) for imparting hair bundle effects. The method (500) starts at block (520) with the selection of a hair bundle (11). Optionally the selection may be performed by referring to instructions as described more in details hereafter. Once the selection is completed, the method continues at block (540) with the application of the tool (1) according to the invention to the selected hair bundle (11). The hair bundle (11) is inserted into the slit (50) of the tool (1) and then received into the through hole (10). Once the selected hair bundle (11) is received in the through hole (10), a portion along the length of the selected hair bundle (11) may extend along the lengthwise dimension of the through hole (10). Thus, that portion of the selected hair bundle (11) is surrounded by the internal surface (200) of the tool (1) and/or the gripping layer (70), if present. The tool (1) is preferably applied by keeping the selected hair bundle (11) substantially straight with one hand and by applying the tool (1) with the other hand. The tool (1) is preferably applied to the root-line of the selected hair bundle (11) as shown in FIG. 7. The steps of selecting a hair bundle (11), optionally by referring to instructions, and of applying the tool (1) according to the invention may be repeated as many times as needed till a plurality of hair bundles (11) have been selected.

Figure 18B:
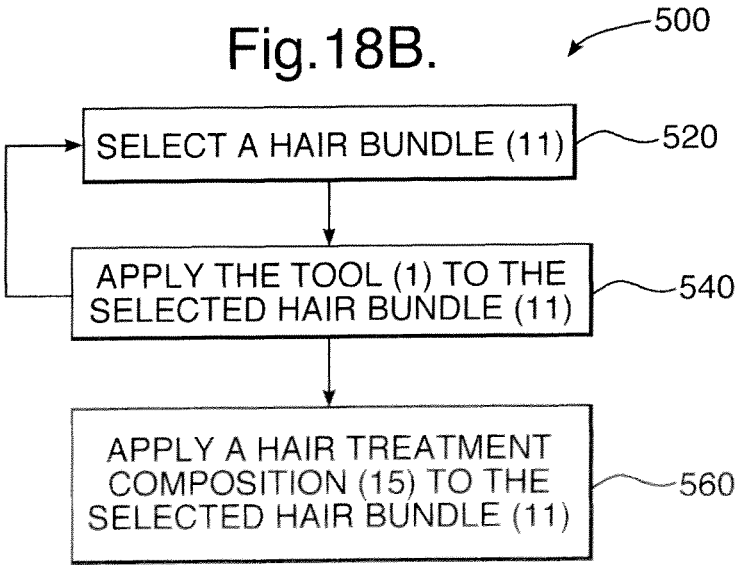
FIG. 18B is a flowchart illustrating an embodiment of a further method (500) for imparting hair bundle effects.

Once these steps (520; 540) have been completed, the method (500) may optionally continue by preparing a hair treatment composition (15) for application onto the selected hair bundle (11). Alternatively, the hair treatment composition (15) is ready for use and thus no preparation is required. The method (500) proceeds with block (560) when the hair treatment composition (15) is applied to selected hair bundle (11) as indicated in the flowchart of FIG. 18B. More preferably the hair treatment composition (15) is applied to the hair bundle (11) from the root to the tips.

The hair treatment composition (15) is selected from the group consisting of highlighting compositions, dyeing compositions, perming compositions, styling compositions and combinations thereof. Preferably, the hair treatment composition (15) is selected from the group consisting of highlighting compositions, dyeing compositions and combinations thereof, more preferably the hair treatment composition (15) is a highlighting composition. Depending on the type of hair treatment composition (15) applied to the hair bundle (11), it may be necessary to remove it, for instance by washing the hair.

When the hair treatment composition (15) is applied to the selected hair bundle (11), the tool (1) according to the invention may be either left in place or removed. In one aspect of the present invention, the tool (1) is left in place when the hair treatment composition (15) is applied but removed when the hair treatment composition (15) is removed. In another aspect, the tool (1) is removed before applying the hair treatment composition (15) to the selected hair bundle (11). In this aspect, the selected hair bundle (11) is held substantially straight with one hand, whilst the tool (1) is removed with the other hand which subsequently applies the hair treatment composition (15) is applied. In yet another aspect of the present invention the tool (1) may be removed by unthreading the tool (1) from the hair bundle (11) simultaneously to the application of the hair treatment composition (15).

The hair treatment composition (15) is applied with applicators (65; 65') as described more in details here after or with fingers.

Kit

For the purpose of sale and/or use, a kit (60) for imparting hair bundle effects may be assembled. One embodiment of the kit (60) is shown in FIG. 19, wherein the features of the kit (60) may be assembled within a package (91), in this specific embodiment a box.

Figure 21B:
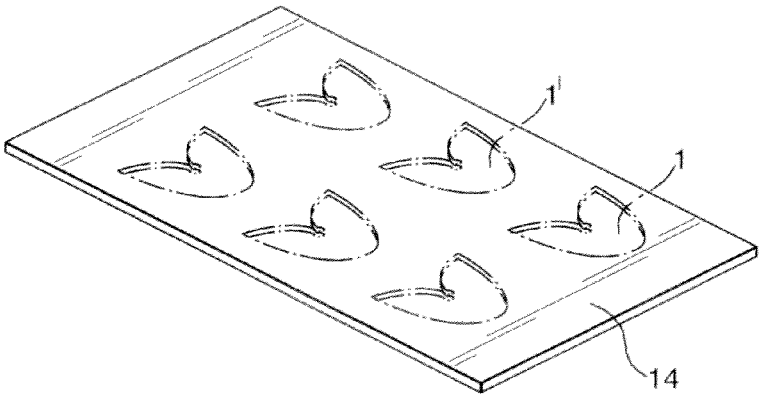
FIG. 21B illustrates an embodiment of the implement (14) according to the invention, wherein the plurality of tools (1; 1') are mechanically attached to the implement (14).

The kit (60) for imparting hair bundle effects comprises at least one tool (1) according to the invention and a hair treatment composition (15). Preferably, the kit (60) comprises a plurality of tools (1), more preferably each tool (1) of the plurality of tools (1) is substantially flat. In another aspect of the present invention, the kit (60) may comprise an implement (14) comprising a plurality of tools (1; 1') as shown in FIGS. 19, 21A and 21B.

The kit (60) may further comprise instructions (92). The instructions (92) may comprise information and directions in how to use the tool (1) and how to prepare and apply the hair treatment composition (15). The instructions (92) may further include one or more illustrations of at least one type of a hair bundle effect and an indication where to select on the head the hair bundles (11) to be treated in order to obtain a similar hair bundle effect.

The hair treatment composition (15) comprised within the kit (60) according to the invention may be packaged in a sachet and/or in a bottle (90). A nozzle (93) may be further provided within the kit (60) to easy the dispensing of the hair treatment composition (15) from the bottle (90).

The hair treatment composition (15) according to the invention is selected from the group consisting of highlighting compositions, dyeing compositions, perming compositions, styling compositions and combinations thereof. Preferably, the hair treatment composition (15) is selected from the group consisting of highlighting compositions, dyeing compositions and combinations thereof, more preferably the hair treatment composition (15) is a highlighting composition.

The hair treatment compositions (15) may further comprise components known, conventionally used, or otherwise effective for use in hair treatment compositions particularly oxidative bleaching and dye compositions which include but are not limited to: oxidizing agents; developer dye compounds; coupler dye compounds; direct dyes; D&C orange #4, D&C Red #28, acid blue, HC Blue #15, napthol yellow S, Disperse red 17, reducing agents; thickeners; chelants; pH modifiers and buffering agents; alkalising agents, carbonate ion sources and radical scavenger systems; glycine; amodimethicone, ethylenediamine disuccinic acid; anionic, cationic, non-ionic, amphoteric or zwitterionic surfactants, or mixtures thereof; anionic, cationic, non-ionic, amphoteric or zwitterionic polymers, hydrophobically modified polymers or mixtures thereof; fragrances; dispersing agents; solvents, peroxide stabilizing agents; chelants, carbomers, stearates, humectants, and derivatives thereof, plant materials (e.g. aloe, chamomile and henna extracts); silicones (volatile or non-volatile, modified or non-modified), film-forming agents, cellulose polymers and their derivatives, ceramides, preserving agents, gel networks, colour indicators and opacifiers. Some adjuvants which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) and are useful in identifying specific adjuvants to achieve a particular purpose or multipurpose. A representative but not exhaustive list of polymers and thickening agents can be found in "The Encyclopedia of Polymers and Thickeners for Cosmetics" compiled and edited by Robert Y. Lochhead, PhD and William R. Fron, Department of Polymer Science, University of Southern Mississippi.

In one aspect of the present invention, the hair treatment composition (15) is prepared by mixing a first individually packaged component and a second individually packaged component. When mixed the first and second individually packaged components form the hair treatment composition (15) to be applied to the selected hair bundle (11). Examples of such compositions include so called semi-permanent and permanent colorants which typically contain oxidative dyes and an oxidant, and highlighting compositions containing an oxidant and an alkalising agent, optionally with a persulfate salt. In one embodiment of the kit (60) according to the present invention the hair treatment composition (15) is a highlighting composition prepared by mixing a first individually packaged component with a second individually packaged component. The first individually packaged component preferably comprises from about 3% to about 12% of hydrogen peroxide by weight of said first individually packaged component. The second individually packaged component is preferably in the form of a powder, granules or paste and comprises from about 10% to about 60% of persulfate salt selected from the group consisting of sodium persulfate, potassium persulfate, ammonium persulfate and mixtures thereof, by weight of said second individually packaged component. The kit (60) optionally comprises a third individually packaged component comprising from about 3% to about 25% of an alkalizing agent in an aqueous vehicle, by weight of said third individually packaged component.

In another embodiment of the present invention, the hair treatment composition (15) is prepared by mixing a first individually packaged component comprising from about 1.5% to about 12% of hydrogen peroxide by weight of said first individually packaged component and a second individually packaged component comprising from about 0.01% to about 6% of a dye selected from the group consisting of direct dyes, oxidative dye precursors, oxidative dye couplers and mixtures thereof, by weight of said second individually packaged component.

The kit (60) according to the invention may further comprise an applicator (65) for applying the hair treatment composition (15) onto the selected hair bundle (11). The applicator (65) may be selected from the group consisting of brush-type applicators, tweezers-type applicators, tongs-like applicators, wand-type applicators, movably joined portions-type applicators and combination thereof. Preferably the applicator (65) comprises two movably joined portions, a first portion movably joined to a second portion.

In one aspect of the present invention the first portion of the applicator (65) is a plate (66) and the second portion is a well (67). The plate (66) is movable joined, preferably by a hinge, to the well (67), so that the plate may be brought into a juxtaposed relationship to the opening of the well and may cover it at least partially. Even more preferably, the plate (66) of the applicator (65) comprises at least one fin (81), yet even more preferably, a first and a second fin (81; 82). The fins (81; 82) projects from the plate (66) and verge one toward the other as shown in FIG. 19. The fins (81; 82) project from the plate in a way that when the plate (66) is brought into a juxtaposed relationship to the well (67), the fins (81; 82) fit at least partially within the cavity of the well (67).

Figure 20:
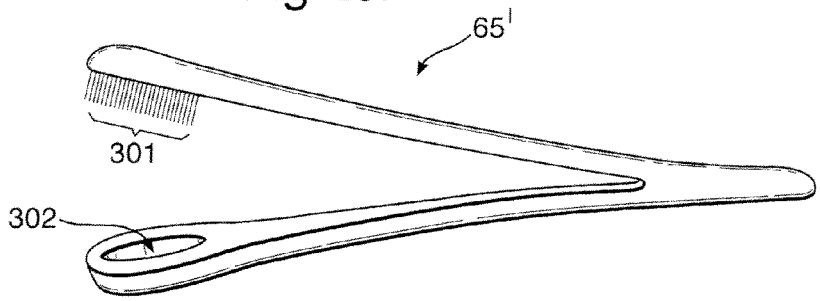
FIG. 20 shows a perspective view of an applicator (65') which can be comprised within the kit (60) for imparting hair bundle effects.

In another aspect of the present invention the kit (60) comprises a tweezers-like applicator (65') as shown in FIG. 20. The applicator (65') is a tweezers-type applicator having at one end of an arm of the tweezers a plurality of fibres (301). The end of the other arm comprises either a cavity (302) or additional plurality of fibres. When the arms of the applicator (65') are compressed, the fibres (301) fit within the cavity (302) or additional plurality of fibres, not shown at the other end. The dimensions and values disclosed herein are not to be understood as being strictly limited to the exact numerical values recite. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tool for separating a hair bundle from the remaining hair, the tool comprising a. an external surface;

b. a through hole within the tool for receiving the hair bundle, wherein the through hole defines on the external surface an upper rim and a lower rim; the through hole further defines within the tool an internal surface;

c. a slit for inserting the hair bundle into the through hole, the slit extending from the external surface through the tool and opening into the through hole;

wherein the slit defines on the external surface a first slit edge and a second slit edge; wherein both the first and the second slit edges join the upper rim and the lower rim of the through hole such that the slit extends from the upper rim to the lower rim of the through hole; wherein the slit defines within the tool a first slit face and a second slit face; and wherein the first slit face has a slit distance (d) from the second slit face;

wherein the tool only comprises one slit;

wherein the tool is substantially flat and wherein the external surface of the tool is divided into a first surface and a second surface and wherein each of the first and second surfaces independently has an area of from 2 $cm^2$ to 15 $cm^2$;

wherein a gripping layer extends upon at least a portion of the first and/or second surfaces of the tool and wherein the gripping layer is made of a material selected from the group consisting of thermo plastic elastomers, rubbers, foam materials and combinations thereof; and wherein the first slit face and the second slit face comprise a waved surface.

2. The tool according to claim 1, wherein the first and the second slit faces form in the tool a neck portion and an accessing portion; wherein the slit distance (d) between the first and the second slit faces in the neck portion is constant and less than 2.0 mm.

3. The tool according to claim 1, wherein a gripping layer extends upon at least a portion of the external surface of the tool and wherein the gripping layer is made of a material selected from the group consisting of thermo plastic elastomers, rubbers, foam materials and combinations thereof.

4. The tool according to claim 1, wherein a gripping layer extends upon at least a portion of the internal surface of the tool, wherein the gripping layer is made of a material selected from the group consisting of thermo plastic elastomers, rubbers, foam materials and combinations thereof.

5. The tool according to claim 1, wherein a gripping layer extends upon at least a portion of the through hole and wherein the gripping layer is made of a material selected from the group consisting of thermo plastic elastomers, rubbers, foam materials and combinations thereof.

6. An implement comprising a plurality of tools as described in claim 1, wherein each tool of the plurality of tools is independently attached to the implement.

* * * * *